US005944351A

United States Patent [19]

Koploy

[11] Patent Number: 5,944,351

[45] Date of Patent: Aug. 31, 1999

[54] BINDING FOR REMOVABLE-SHEET BOOK

[76] Inventor: Randolph A. Koploy, 11120 Southridge Way, San Diego, Calif. 92131

[21] Appl. No.: 09/005,473

[22] Filed: Jan. 12, 1998

[51] Int. Cl.[6] ..... B42D 15/00; B42D 15/04; B42D 15/10

[52] U.S. Cl. ..... 281/15.1; 281/21.1; 283/57; 283/58; 462/31

[58] Field of Search ..... 283/57, 58; 281/21.1, 281/15.1; 462/31

[56] References Cited

U.S. PATENT DOCUMENTS

| | | | |
|---|---|---|---|
| 48,710 | 10/1865 | Roqueplo . | |
| 1,220,589 | 3/1917 | Bender | 283/79 |
| 2,382,476 | 8/1945 | Glasoe, Jr. | 281/31 |
| 2,678,223 | 5/1954 | Shepherd | 282/23 |
| 2,840,393 | 6/1958 | Youngquist | 282/22 |
| 3,258,277 | 6/1966 | Schuster | 282/22 |
| 3,734,543 | 5/1973 | Donovan | 282/23 R |
| 4,392,675 | 7/1983 | Winiarski | 282/23 R |
| 5,126,547 | 6/1992 | Norman, Jr. | 283/57 |

*Primary Examiner*—Willmon Fridie, Jr.
*Assistant Examiner*—Mark T. Henderson
*Attorney, Agent, or Firm*—Frank D. Gilliam

[57] ABSTRACT

A high security removable page book, such as a check book, receipt book, etc. that protects against inadvertent removal of more than one page at a time and prevents removal of a page from the back of the book. In one embodiment, each page has at least one extension along one edge. The extensions on alternate pages are along different edges, preferably opposite edges. Pages are removed by alternately lifting opposite edges for alternate pages. Thus, the second and succeeding pages are not liftable until pages above have been sequentially removed. Pages preferably include indicia showing which end of each page is to be lifted. A copy sheet may be provided behind each page to record a copy of information written on the page. The copy pages may be folded out of the way. A card is hinged to the assembly in a manner permitting it to be introduced under a copy sheet to prevent print-through. In another embodiment, extensions are provided along each edge, with extensions on two opposite edges near corners cater corner from each other to leave a free corner that may be lifted for page removal.

21 Claims, 3 Drawing Sheets

BINDING FOR REMOVABLE-SHEET BOOK

FIELD OF THE INVENTION

This invention relates to books, such as checkbooks, in which pages are sequentially removed from the book, where it is undesirable to have more than one page removed at a time or to have other than a top page in the book removed.

BACKGROUND OF THE INVENTION

Check books, receipt books, coupon packs, traffic citation books and other books where pages are to be removed one at a time from the top of stacked pages generally have the pages releasably secured together along one edge. The releasable securing means may be perforations connecting the page portion to be removed to page extensions that are secured together by staples, adhesive or the like. In some cases, a rubbery adhesive is coated along an edge of the page stack to allow pages to be pulled away one at a time.

Generally, a stub is provided at the end of the check for receiving information identifying the payee and the amount of the attached check. This tends to make the checkbook rather long. A stub may be folded over the check to reduce the length of the checkbook, as described by Roqueplo in French Patent No. 2,597,408. In either case, perforations between check and stub allow the check to be removed. In other cases, the checks are bound together along one long edge and a check register is provided for entering information about the check.

Sometimes receipt books, check books and the like often have a check stub or copy page behind each original check, receipt, etc, with either carbon paper or a pressure sensitive marking material between the original and copy pages to make a copy any writing on the original. Typical of such checkbooks are those described by Winiarski in U.S. Pat. No. 4,392,675 and Shepard in U.S. Pat. No. 2,678,223. Generally, a sheet of cardboard or the like must be placed behind the copy page when writing on the original to prevent the writing from appearing on subsequent pages.

While generally effective, these arrangements have several problems. After writing a check or receipt, etc., two pages can be inadvertently gripped and removed together. A loose check may be accidentally sent with the original or may be lost and forged by a miscreant. Generally, receipt books pages are numbered and it is important that all receipts be accounted for. A second, blank, receipt removed with one that has been filled out can be easily lost.

If a check book is left unattended in a public place, someone can easily remove a check from the back of the book to forge and cash. The owner will likely not notice for some time that the back of the book check has been removed.

Thus, there is a continuing need for improvements in checkbooks, receipt books and the like which are more convenient to use, provide protection against inadvertent removal of more than one page when only one was desired and protect against removal of a page other than the top page.

SUMMARY OF THE INVENTION

The above-noted problems, and others, are overcome in accordance with this invention by a book in which extensions along different sides of a stack of pages are alternately bound to binding means along those edges. Where the pages are rectangular, the binding means may be along opposite long or short edges, or along one long edge and one short edge, or along all four edges, as desired.

Where it is desired to have a copy page behind each original page, the copy pages can be bound to an extension beyond an edge to which the original pages are bound, so that after each original is filled out and removed the copy can be folded around to the back of the assembly. If desired, a low-tack adhesive could be used between the original check and the copy, to hold them together until the original check is removed.

If a card sheet is necessary behind the original and copy to prevent print-through, a card stock or plastic sheet may be hingedly mounted adjacent the fourth side of the stack (the original pages being bound to first and second sides and the copy page to the third side).

Where the binding portion runs less than the entire length of edges, the sets of pages can be easily assembled by providing at least three (preferably four) upstanding posts, sized and spaced to fit into the notches between the edge of the page and the extending binding. Then alternate pages are simply stacked between the posts, being automatically aligned. The binding extensions can be secured together by any suitable means, such as adhesive binding, staples, sewing, etc. This arrangement can be easily automated, with an automatic feeder, page counter and means for lifting away the completed assembly. Preferably, the extensions are bonded together by a pressure sensitive adhesive or a heat activated adhesive. If desired, a low-tack adhesive may be used to releasably hold edges together where those edges are not connected to extensions.

While the book and pages may be a check book, receipt book etc., for convenience in describing the invention, the check book embodiment will be illustrated. Other types of books will be constructed in the same manner, with the dimensions of the pages adjusted appropriately.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
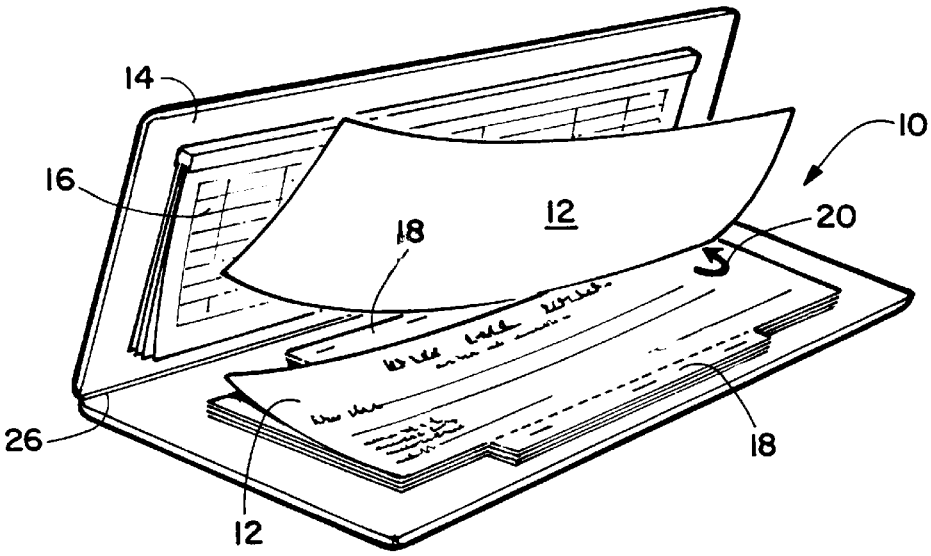
FIG. 1 is a perspective view of a first embodiment showing plural pages in a cover.
Figure 2:
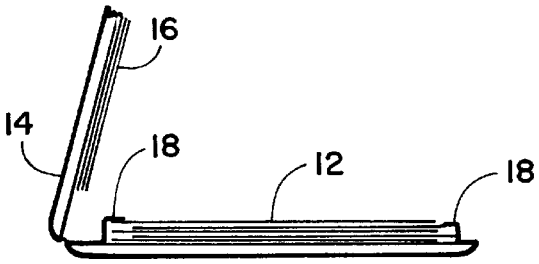
FIG. 2 is an end elevation view of the embodiment of FIG. 1.

Referring to FIGS. 1 and 2, there is seen a checkbook 10 enclosing a stack of checks 12, which when removed from the checkbook are conventional in size and configuration. While checks are described in this description of preferred embodiments, any other forms that are maintained in a stacked relationship and used and removed one by one from the stack could be assembled in the manner of this invention.

Checkbook 10 includes a folder 14 for enclosing checks 12. The stack of checks 12 may be secured to folder 14 in any suitable manner, such as a tab on the back of the stack fitting in a pocket (not shown) in the folder or pressure sensitive adhesive. A conventional check register 16 may be similarly secured in folder 14 opposite checks 12. If desired, a number of deposit slips may be included with check register 16, perforated for easy removal. Alternatively, the deposit slips may be included behind the checks.

Figure 3:
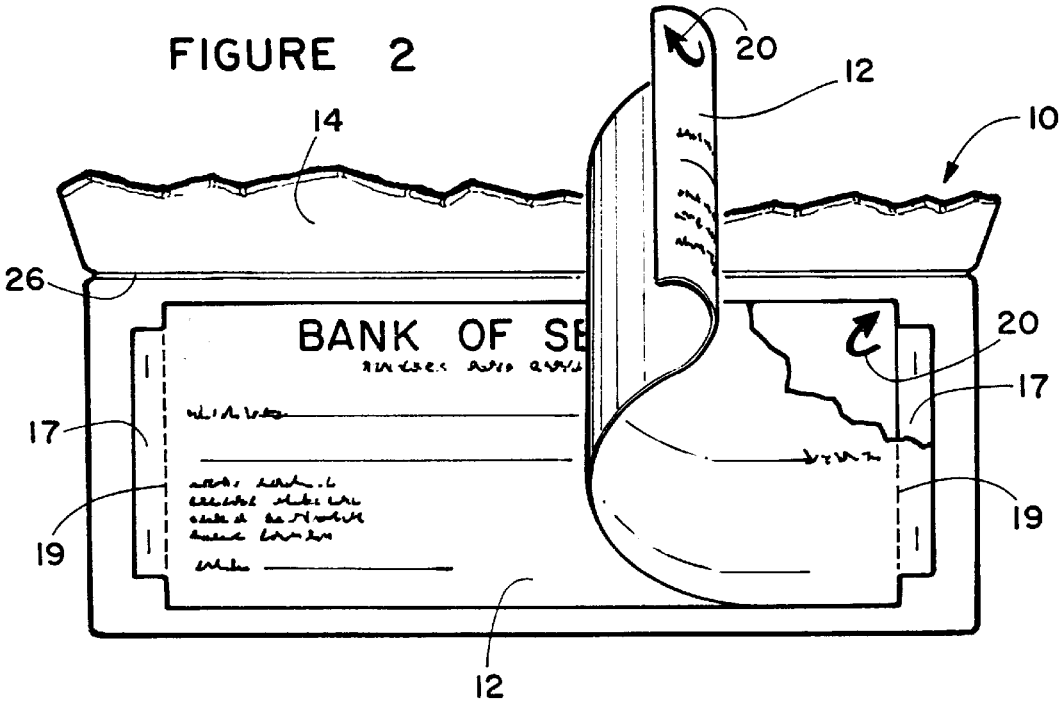
FIG. 3 is plan view of an alternative embodiment with an alternate binding arrangement.
Figure 4:
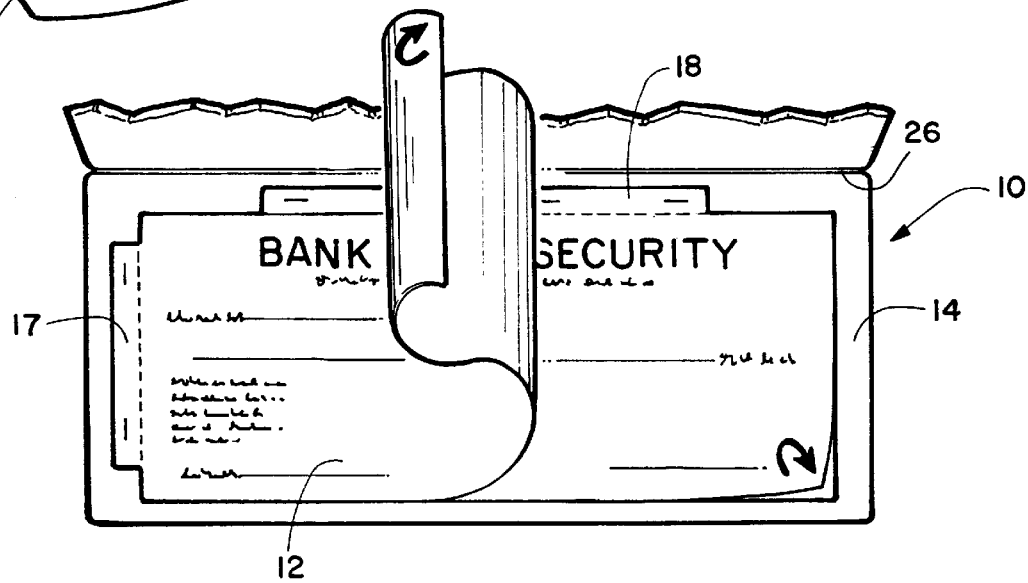
FIG. 4 is a plan view of another alternative embodiment with an alternate binding arrangement.

Each rectangular check 12 has at least one extension 18 along at least one wider edge and/or an extension 17 along at least one narrower end. The extensions may have any suitable width and number. For example extensions 18 lie along opposite long sides of checks 12, alternately through the stack of checks, as shown. Alternatively, extensions 17 may be used on opposite narrow ends of checks 12, as seen in FIG. 3 or extensions 17 and 18 along adjacent ends, as seen in FIG. 4. While a single long extension 18 is shown along each side of the stack of checks, if desired two or more short, spaced, extensions 18 could be used in place of each long extension 18.

Extensions 17 and 18 are bound together, such as by an adhesive, staples, sewing or the like to form stacks. If desired, small strips of paper could be interleaved in each stack to accommodate the fact that each stack of extensions has half as many sheets as does the central check stack. Alternatively, the extensions may be wider and folded under before the stack is fastened together so that stacks of checks and copies will have the same thickness as the stack of extensions.

Each check will bear the usual information as provided on conventional checks. In addition, indicia 20 of any suitable type is preferably provided at an appropriate corner of each check to indicate which end of the check should be lifted for removal. Each succeeding check in the stack will have the indicia at opposite ends. As seen in FIGS. 1 and 3, a small curved arrow may be used to indicate the free (not fastened to an extension) end of each succeeding check.

Many banks no longer return copies of canceled checks to their customers. Therefore, many customers prefer checkbooks that have sheets of copy paper interleaved behind each check. When a check is written, a copy of all entries is created on the copy sheet. Generally, it is preferable that a sheet of stiff material, e.g. cardstock or thin stiff plastic, be provided to be placed behind the copy sheet so as to prevent print-through to succeeding copy sheets.

Figure 5:
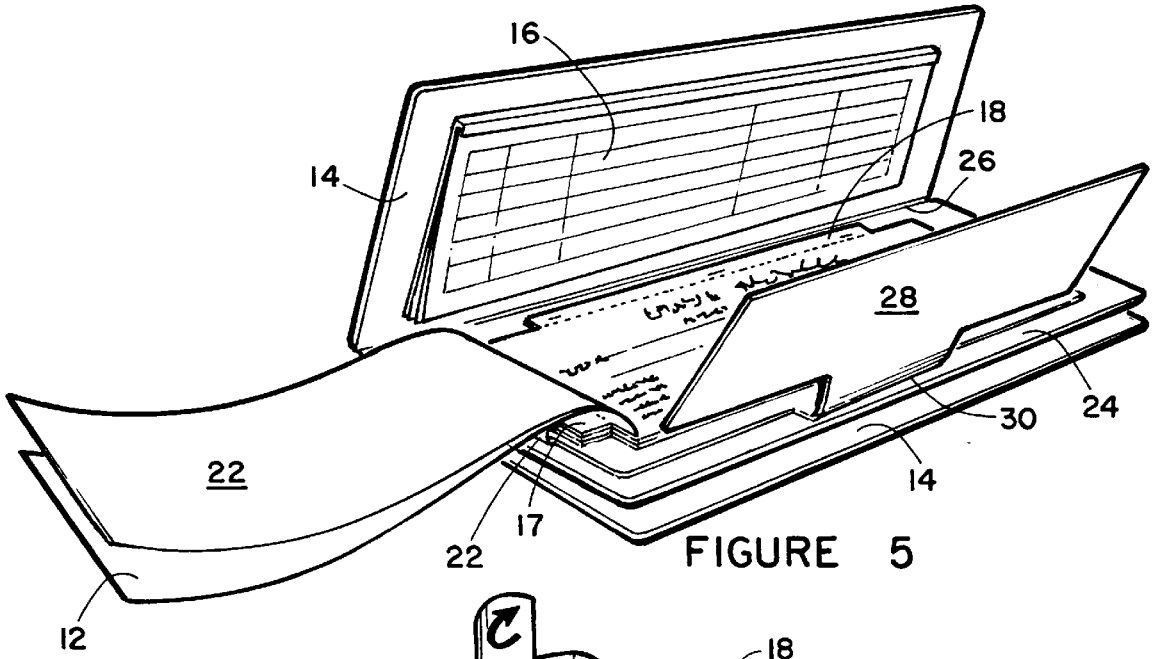
FIG. 5 is a perspective view of another alternative embodiment having interleaved stubs and a backing sheet.

FIG. 5 shows an embodiment that accommodates this need. Checks 12 have two spaced extensions 17 along opposite ends, one of which is visible.

A copy sheet 22 is provided behind each check 12. Each copy sheet is bonded to an extension 17 corresponding to the extension on the overlying check. When a check 12 is written, the check is removed at the perforations between the check and extension 18. The copy sheet 22 is then wrapped around the end of checkbook 10. To accommodate a plurality of copy sheets 22, preferably checks 12 and extensions 17 and 18 are mounted on a backing sheet 24 of plastic, cardstock or the like that is hingedly secured to folder 14 along a hinge line 26. Then, backing sheet 24 can be pivoted up away from folder 14 so that copy sheet can be wrapped around the adjacent end of backing sheet 24, so as to be between the inside surface of folder 14 and the back side of backing sheet 24 when the folder is closed. As checks fastened at alternate ends are used, copy sheets 22 will be wrapped around opposite ends of backing sheet 24. If desired, all extensions for all copy sheets 22 could be at one end of the check book so that all copy sheets would be wrapped around that end.

Of course, where the stack of pages is directly fastened to folder 14, that flap of the folder will be the backing sheet. Then the copy sheets would be allowed to overlap the top page in two stacks from each end and would simply be swung to the sides, out of the way, when a new check is to be written.

When all checks in the check book are used, the copy sheets can be brought back to the front of the backing sheet 24. While a check register 16 may not be required where copies are made, deposit slips may be conveniently mounted where check register 16 is shown.

In order to prevent print-through of writing on one check appearing on later copy sheets 22, preferably a cardstock or stiff plastic card 28, hinged (such as by a flexible tape, row of perforations, etc.) along line 30 is provided. A check 12 and copy sheet 22 can be lifted out of the way, card 28 can be swung around to lie above the remaining checks, the lifted check copy sheet can be replaced and the check written. The written check 12 is separated from its extension, copy sheet 22 is folded under backing sheet 24 and card 28 is pivoted away from the check stack to lie under backing sheet 24. Card 28 could be hinged adjacent to any of the four edges of the stack of checks 12.

If desired, card 28 could be a loose card, stored in any convenient manner, such as between backing sheet 24 and folder 14 or behind check register 16.

Figure 6:
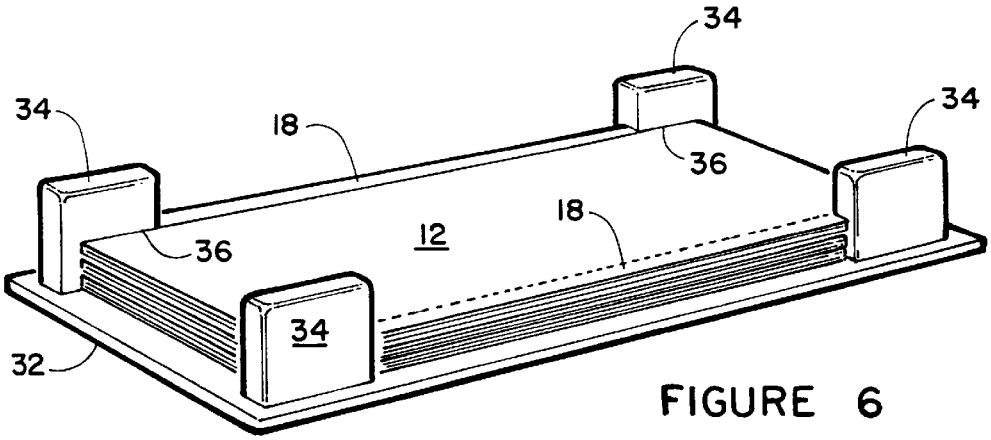
FIG. 6 is a schematic plan view showing a fixture for assembling the pages for binding.

The stack of checks 12 with alternate extensions 17 and/or 18 may be assembled and bonded together in any suitable way. A preferred arrangement is shown in FIG. 6. A base 32 has four spaced upwardly extending posts 34. Posts 34 are arranged to fit into the notches 36 formed by check 12 and extensions 17 and/or 18. This arrangement will assure that the checks are in a uniform stack. During placement of the checks, a pressure sensitive adhesive may be used to bond the extensions together.

Figure 7:
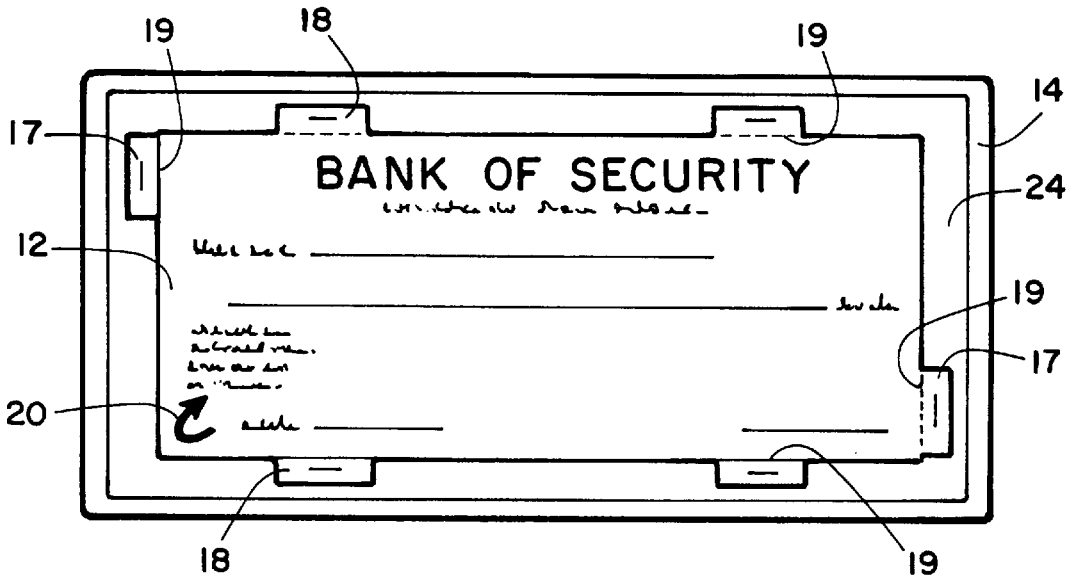
FIG. 7 is a plan view of further embodiment having extensions on each of the four sides.
Figure 8:
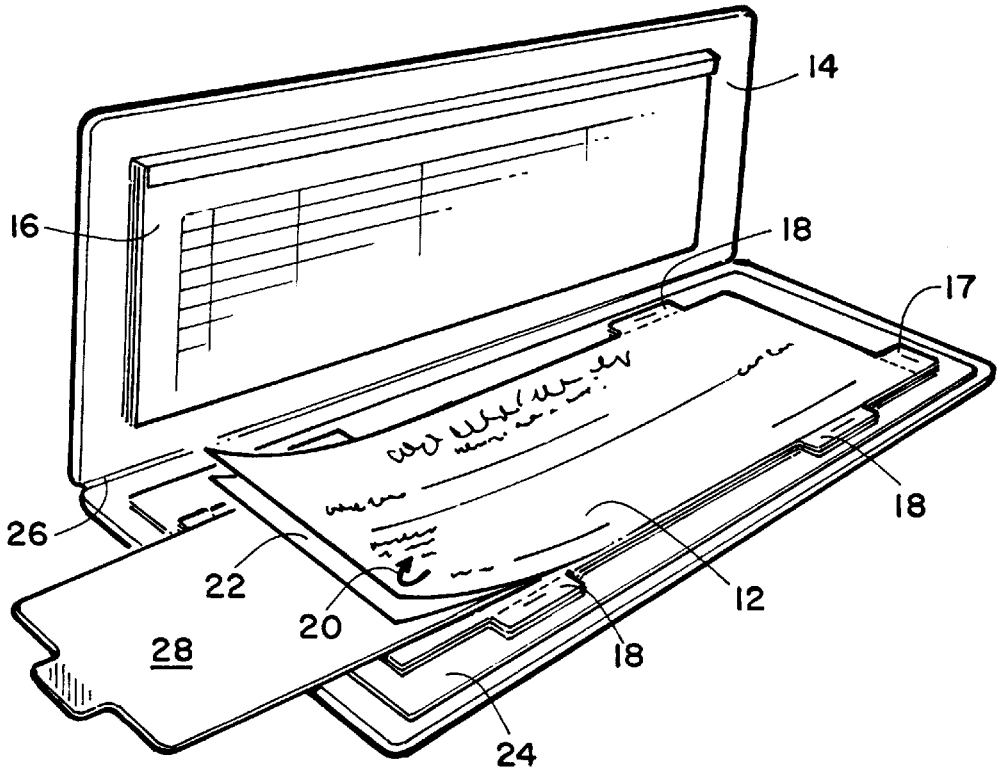
FIG. 8 is a perspective view of the embodiment of FIG. 7 in which copy sheets and a backup sheet are included.

Another embodiment of the secure checkbook is shown in FIGS. 7 and 8. Here, each original check 12 has an extension 18 on either a first or second long side and an extension 17 on one of first and second narrow side. The extensions 17 on the narrow ends of alternate checks 12 are cater corner from each other. Preferably, the narrow end extensions 17 are at or near the corner.

Pairs of spaced extension 18 are provided on alternately on each of the first or second wider sides of checks 12. While the pairs of smaller extensions 18 are preferred for most efficient mounting of checks and easiest removal, if desired a single longer extension could be used on one or both wider sides.

In use, each check 12, after being written will be lifted from a corner marked by an arrow 20 and easily removed from the stack via perforations 19 between extensions and checks. Arrows 20 will be at alternate ends of checks 12, along the narrow edges opposite end extensions 17.

Where copy sheets 22 are used, they can be removed when the check 12 is removed and stored in any convenient manner, such as behind check register 16. Alternately, when a check 12 is removed, the copy sheet 22 could be separated from the end extensions 17 and side extension 18 along one edge. Then, when the next check is written, the accumulated copy sheets could be simply temporarily folded back out of the way. When copy sheets are used preferably a card 28 is removed from a storage area, such as behind register 16, and inserted below the top check 12 and copy sheet 22. For convenience, check 12 and copy sheet 22 can be temporarily lightly held together by a low-tack adhesive or the like. When the set of check and copy sheet is lifted initially, the perforations at the end extension at the lifted end will be the first to release, providing room to insert card 28.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A page binding assembly for a removable page book, which comprises:

a backing sheet;

a first set of pages in stacked relationship on said backing sheet;

a first extension along a first edge of each of said first set of pages;

first binding means for binding said first extensions together and to said backing sheet;

means for allowing removal of said pages from said first binding means;

a second set of pages in stacked relationship on said backing sheet;

said first and second sets of pages interleaved and forming a substantially coextensive combined stack;

a second extension along a second edge of each of said second set of pages;

second binding means for binding said second extensions together and to said backing sheet;

said first and second binding means along different edges of said combined stack; and removal means for aiding removal of pages from said second binding means.

2. The page binding assembly for a removable page book according to claim 1 wherein said removal means comprises a line of perforations between said pages and said extensions.

3. The page binding assembly for a removable page book according to claim 1 wherein said first and second binding means are positioned on opposite sides of said combined stack.

4. The page binding assembly for a removable page book according to claim 1 wherein said first and second binding means are positioned on adjacent sides of said combined stack.

5. The page binding assembly for a removable page book according to claim 1 further including copy sheets behind each page, said pages and copy sheets containing pressure sensitive duplicating material to make a copy on a copy sheet of writing on a corresponding page, said copy sheets being releasably secured to binding means on at least one side of said stack.

6. The page binding assembly for a removable page book according to claim 5 wherein at least of said binding means comprises a low-tack adhesive between a page an associated copy sheet.

7. The page binding assembly for a removable page book according to claim 1 further including a card hingedly secured to said backing sheet on a side other than sides of said combined stack having a binding means.

8. The page binding assembly for a removable page book according to claim 1 further including visible indicia on said pages indicating unbound edges for finger engagement for page removal.

9. A page binding assembly for a removable page book, which comprises:

a backing sheet;

a first set of pages in stacked relationship on said backing sheet;

a first extension along a first edge of each of said first set of pages;

first binding means for binding said first extensions together and to said backing sheet;

means for allowing removal of said pages from said first binding means;

a second set of pages in stacked relationship on said backing sheet;

said first and second sets of pages interleaved and forming a substantially coextensive combined stack;

a second extension along a second edge of each of said second set of pages;

second binding means for binding said second extensions together and to said backing sheet;

said first and second binding means along opposite edges of said combined stack;

removal means for aiding removal of pages from said second binding means;

copy sheets interleaved between said pages to form a combined stack of pages over copy sheets;

surfaces of at least some of said pages and said copy sheets having pressure sensitive duplicating material configured to make a copy on a copy sheet of writing on a page; and said copy sheets being secured to binding means on edges of said combined stack other than said opposite edges.

10. The page binding assembly for a removable page book according to claim 9 wherein said removal means comprises a line of perforations between said pages and said extensions.

11. The page binding assembly for a removable page book according to claim 9 further including a card hingedly secured to said backing sheet on a side other than sides of said combined stack having adjacent first, second or third binding means.

12. The page binding assembly for a removable page book according to claim 9 further including visible indicia on said pages indicating unbound edges for finger engagement for page removal.

13. A page binding assembly for a removable page book, which comprises:

a backing sheet;

a coextensive stack of generally rectangular pages on said backing sheet;

said pages alternately having extensions releasably secured thereto on first and second different sides of said stack and having a free edge opposite said extensions;

said extensions on each of said first and second sides being bound together and to said backing sheet;

whereby a top page can be removed by lifting the free edge of said top page while free edges of subsequent pages are not accessible.

14. The page binding assembly for a removable page book according to claim 13 further including a copy sheet under said page, pressure sensitive duplicating material operatively disposed on at least one of said page and copy sheet to make a copy on said copy sheet of writing on said page, and said copy sheets having extensions bound to said backing sheet.

15. The page binding assembly for a removable page book according to claim 14 further including a card hingedly secured to said backing sheet for movement from a first position over said stack and a second position under said backing sheet.

16. The page binding assembly for a removable page book according to claim 13 wherein a line of perforations are provided between each page extension and page to assist separation of said pages from said extensions.

17. The page binding assembly for a removable page book according to claim 12 further including visible indicia on said pages indicating unbound edges for finger engagement for page removal.

18. A page binding assembly for a removable page book, which comprises:

a backing sheet;

a set of pages in stacked relationship on said backing sheet;

said pages having two opposite longer first and second sides and two opposite narrower first and second ends forming a generally rectangular configuration;

at least one side extension along each of said longer sides;

an end extension along each narrower end, said end extensions approximately at corners between sides and ends, cater corner from each other;

pages alternately having extensions on said first side and said first end and having extensions on said second side and said second end;

said extensions being bonded together and to said backing sheet; and perforations formed between said pages and said extensions;

whereby uppermost pages can be individually removed and access to lower pages in said set is restricted.

19. The page binding assembly for a removable page book according to claim 18 further including indicia on each of said pages adjacent to a corner of an end and side not having an end extension to indicate the corner of the page to be lifted for removal.

20. The page binding assembly for a removable page book according to claim 18 wherein each of said pages includes two stacked substantially coextensive sheets and means for forming a copy image on the undermost sheet of writing on the uppermost sheet.

21. The page binding assembly for a removable page book according to claim 20 further including a folder for surrounding said pages and backing sheet, and further including a card storable in said folder for insertion between an uppermost two-sheet page and the next two-sheet page to prevent print-through when the uppermost sheet is written upon.

* * * * *